US010502021B2

(12) United States Patent
Healy

(10) Patent No.: US 10,502,021 B2
(45) Date of Patent: Dec. 10, 2019

(54) VALVE REMOVAL PLUG ASSEMBLY

(71) Applicant: Cameron International Corporation, Houston, TX (US)

(72) Inventor: Paul Healy, Claremorris (IE)

(73) Assignee: Cameron International Corporation, Houston, TX (US)

( * ) Notice: Subject to any disclaimer, the term of this patent is extended or adjusted under 35 U.S.C. 154(b) by 239 days.

(21) Appl. No.: 15/393,061

(22) Filed: Dec. 28, 2016

(65) Prior Publication Data

US 2018/0179854 A1 Jun. 28, 2018

(51) Int. Cl.

| | |
|---|---|
| ***E21B 34/02*** | (2006.01) |
| ***E21B 47/00*** | (2012.01) |
| ***E21B 33/03*** | (2006.01) |
| ***E21B 33/068*** | (2006.01) |
| ***E21B 47/06*** | (2012.01) |

(52) U.S. Cl.

CPC ..... *E21B 34/02* (2013.01); *E21B 33/03* (2013.01); *E21B 33/068* (2013.01); *E21B 47/00* (2013.01); *E21B 47/06* (2013.01)

(58) Field of Classification Search

CPC ..... E21B 34/02; E21B 33/103; E21B 33/068; E21B 47/00; E21B 47/06

See application file for complete search history.

(56) References Cited

U.S. PATENT DOCUMENTS 9,217,322 B2 * 12/2015 Kleppa ..... E21B 33/0355
9,988,870 B2 6/2018 Gray
2013/0027215 A1 1/2013 Kleppa
2014/0216715 A1 * 8/2014 Kleppa ..... E21B 33/0355 166/66
2017/0044861 A1 * 2/2017 Guedes ..... E21B 23/02

FOREIGN PATENT DOCUMENTS

| | | | |
|---|---|---|---|
| NO | 333416 | B1 | 6/2013 |
| WO | 20030016673 | A1 | 2/2003 |
| WO | 2013056859 | A1 | 4/2013 |
| WO | 2015162241 | A1 | 10/2015 |
| WO | 2018106119 | A2 | 6/2018 |
| WO | 2018160070 | A1 | 9/2018 |

OTHER PUBLICATIONS

PCT International Search Report & Written Opinion for PCT Application No. PCT/US2017/068298 dated May 4, 2018; 14 pages.

* cited by examiner

*Primary Examiner* — Nicole Coy
(74) *Attorney, Agent, or Firm* — Eubanks PLLC

(57) ABSTRACT

A system includes a first valve removal (VR) plug, a VR plug housing, and a second VR plug. The first VR plug includes a sensor configured to sense a characteristic of a first volume adjacent to the first VR plug and to wirelessly transmit a signal indicative of the sensed characteristic, wherein the first VR plug is configured to form a first seal with a flange of a mineral extraction component. The VR plug housing includes a first flange configured to be disposed about the VR plug and to couple to the flange of the mineral extraction component, a second VR plug recess comprising an interior threaded surface, and a second flange disposed about the second VR plug recess. The second VR plug includes a threaded exterior surface configured to engage with the threaded interior surface of the second VR plug recess to form a second seal between the second VR plug and the VR plug housing.

21 Claims, 8 Drawing Sheets

VALVE REMOVAL PLUG ASSEMBLY

BACKGROUND

This section is intended to introduce the reader to various aspects of art that may be related to various aspects of the present disclosure, which are described and/or claimed below. This discussion is believed to be helpful in providing the reader with background information to facilitate a better understanding of the various aspects of the present disclosure. Accordingly, it should be understood that these statements are to be read in this light, and not as admissions of prior art.

Oil and natural gas have a profound effect on modern economies and societies. In order to meet the demand for such natural resources, numerous companies invest significant amounts of time and money in searching for, accessing, and extracting oil, natural gas, and other subterranean resources. Particularly, once a desired resource is discovered below the surface of the earth, drilling and production systems are often employed to access and extract the resource. These systems can be located onshore or offshore depending on the location of a desired resource. Such systems generally include a wellhead assembly through which the resource is extracted. These wellhead assemblies generally include a wide variety of components and/or conduits, such as blowout preventers (BOPs), as well as various control lines, casings, valves, and the like, that control drilling and/or extraction operations. Valve removal plugs (VR plugs) may be used to plug a fluid passageway and maintain pressure in the wellhead assembly (e.g., an annulus around a production bore), such that a valve (e.g., a gate valve, a ball valve, etc.) may be installed behind the VR plug. The VR plug may then be removed and fluid may flow to the valve. Typically, a pressure containment flange is placed behind the VR plug in order to maintain two barriers between the bore hole and/or well fluids and the external environment. Unfortunately, when a VR plug becomes loose, fluid may potentially leak from the wellhead assembly into a volume between the VR plug and the containment flange. When this occurs, operators are no longer able to maintain two barriers and removal of the pressure containment flange may result in release of bore hole and/or wellhead fluids unless the well has been "killed", negatively affecting the productivity of the well.

BRIEF DESCRIPTION OF THE DRAWINGS

Various features, aspects, and advantages of the present disclosure will become better understood when the following detailed description is read with reference to the accompanying figures in which like characters represent like parts throughout the figures, wherein.

Various features, aspects, and advantages of the present disclosure will become better understood when the following detailed description is read with reference to the accompanying figures in which like characters represent like parts throughout the figures, wherein.

DETAILED DESCRIPTION OF SPECIFIC EMBODIMENTS

Figure 1:
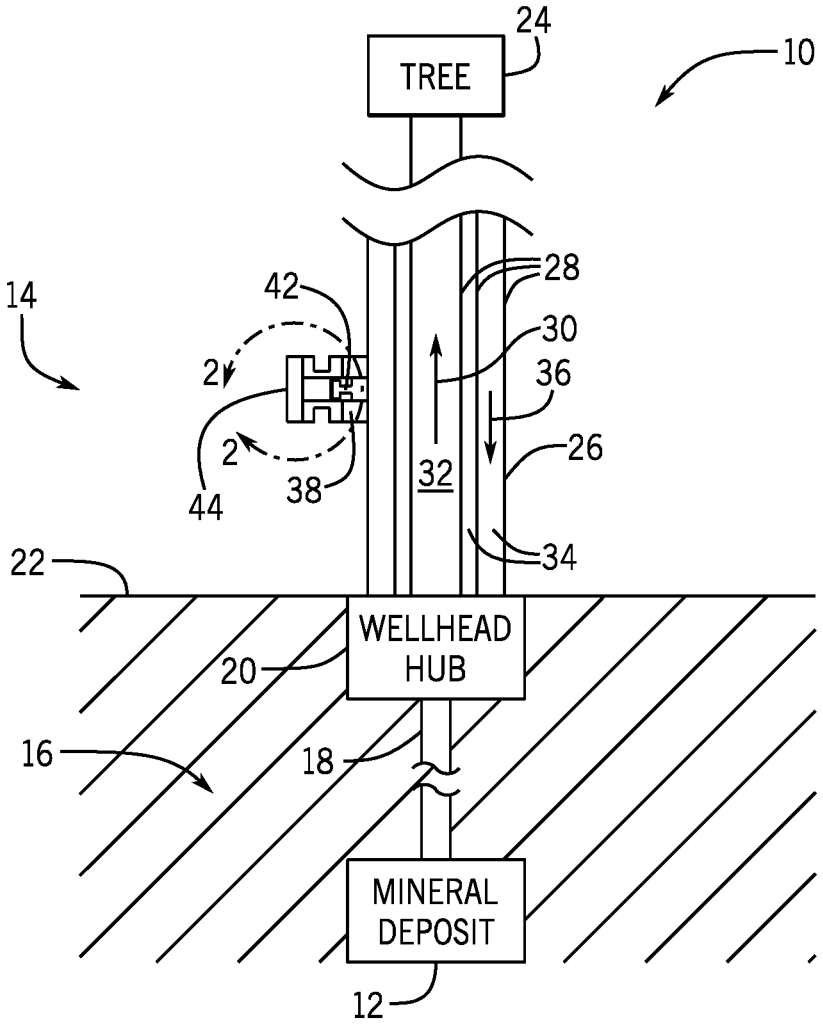
FIG. 1 is a schematic of an embodiment of a mineral extraction system.

One or more specific embodiments of the present disclosure will be described below. These described embodiments are only exemplary of the present disclosure. Additionally, in an effort to provide a concise description of these exemplary embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present disclosure, the articles "a," "an," "the," and "said" are intended to mean that there are one or more of the elements. The terms "comprising," "including," and "having" are intended to be inclusive and mean that there may be additional elements other than the listed elements. Moreover, the use of "top," "bottom," "above," "below," and variations of these terms is made for convenience, but does not require any particular orientation of the components.

Mineral extraction systems are used to extract various minerals and natural resources, including hydrocarbons (e.g., oil and/or natural gas) from a mineral deposit or reservoir. Further, such systems include a wellhead assembly that has a tree assembly through which the mineral or resource is extracted. Wellhead and tree assemblies may include control lines, casings, hangers, valves, chokes and the like, that control drilling and/or extraction operations. Valve removal plugs (VR plugs) may be used to plug a fluid passageway (e.g., an annulus around a production bore) and maintain pressure, such that a valve (e.g., a gate valve, a ball valve, etc.) may be installed behind the VR plug. The VR plug may then be removed and fluid may flow to the valve. In some embodiments, "smart" VR plugs may include sensors (e.g., pressure sensors, temperature sensors, etc.) for sensing characteristics within the wellhead assembly. Typically, a pressure containment flange is placed behind the VR plug in order to maintain two barriers between the bore hole and/or well fluids and the external environment. Unfortunately, when a VR plug becomes loose, the volume between the VR plug and the pressure containment flange may become pressurized. Once the volume behind the VR plug is pressurized, accessing the VR plug may release bore hole and/or wellhead fluids unless the well has been "killed", which may negatively affect the productivity of the well.

The disclosed techniques include the placing a secondary VR plug behind the primary VR plug. As will be described in more detail below, a lubricator tool may extend through a gate valve to tighten or replace the primary VR plug without losing pressure in the well. The gate valve may then be replaced with a blind flange.

FIG. 1 is a side, section view of an exemplary mineral extraction system 10 configured to extract various natural resources, including hydrocarbons (e.g., oil and/or natural gas), from a mineral deposit 12. Depending on where the natural resource is located, the mineral extraction system 10 may be land-based (e.g., a surface system) or subsea (e.g., a subsea system). The illustrated system 10 includes a wellhead assembly 14 coupled to the mineral deposit or reservoir 12 via a well 16. Specifically, a wellbore 18 extends from the reservoir 12 to a wellhead hub 20 located at or near the surface 22.

The illustrated wellhead hub 20, which may be a large diameter hub, acts as an early junction between the well 16 and the equipment located above the well 16. The wellhead hub 20 may be configured to support various strings of casing or tubing that extend into the wellbore 18, and in some cases extending down to the mineral deposit 12.

The wellhead assembly 14 generally includes devices and components that control and regulate activities and conditions associated with the well 16. For example, the wellhead assembly 14 may include what is known in the industry as a Christmas tree assembly 24, or tree, designed to route the flow of produced minerals (e.g., produced flow) from the mineral deposit 12 and the wellbore 18, to regulate pressure in the well 16, and to facilitate the injection of chemicals into the wellbore 18 (e.g., downhole). Trees 24 may include an assemblage of valves, flow paths, and access points employed to monitor, control, and service the well 16.

The wellhead assembly 14 has a body 26, which supports various components and defines various flow paths for operating the well 16. For example, the wellhead assembly 14 has a production bore 32 that is in fluid communication with the well 16 and that facilitates completion and workover operations, such as insertion of tools, installation of shoulders, and landing of hangers, to name just a few.

Minerals extracted from the well 16 (e.g., oil and natural gas) are routed (arrow 30) through the production bore 32. Produced minerals may flow through the production fluid bore 32 to other mineral extraction components, which may include measurement equipment (e.g., multi-phase flow meter, ultrasonic flow meter, temperature sensor, pressure sensor, etc.) for measuring one or more characteristics of the produced mineral flow (e.g., contents of the flow, flow rate, viscosity, temperature, etc.). In some embodiments, the mineral extraction component may also include one or more flow control devices, such as valves and/or chokes. The produced minerals may be pumped through the mineral extraction component for storage, transport, refining, etc.

One or more strings of annular tubing 28 (e.g., casing strings, tubing strings, etc.) may be disposed about the production bore 32, forming an annulus 34 or annuli disposed about the production bore 32. In some embodiments, the annuli 34 may be used as fluid flow paths for injecting chemicals "downhole" into the well 16. For example, lift gas may be injected through the annulus 34 in a direction opposite the production flow 30, as indicated by arrow 36, in order to increase production. In other embodiments, fluid may flow through the annuli 34 in the same direction as the production flow 30. In some embodiments, the annuli 34 may be pressurized.

To control and regulate flow in and out of the well 16, the wellhead assembly 14 may include various valves—e.g., ball valves, gate valves—in fluid communication with the flow paths defined by the above-described bores (e.g., 32, 34). As shown, a threaded valve replacement plug 42 (VR plug) may be used to plug a fluid flow path, such that a valve may be accessed, serviced, removed, and/or installed at a later time. When installed, the VR plug 42 may form a seal with the flange 38 of the body 26, such that fluid may not flow past the VR plug 42 and such that pressure may be maintained on either side of the VR plug 42. In some embodiments, the VR plug 42 may be a smart VR plug 42 outfitted with sensors (e.g., pressure sensors, temperature sensors, flow sensors, fluid composition sensors, etc.) to determine environmental characteristics on either side of the VR plug 42.

Whereas some of the flanges 38 of the body 26 may be coupled to mineral extraction components, other flanges 38 may be coupled to a blind flange 44, which may act as a cap for the various fluid passages. For example, an o-ring, or other seal, may be disposed between the flange 38 of the body 26 and the blind flange 44, such that the pressure is maintained inside the fluid passage 32, 34 of the body 26.

In order to install a valve, the blind flange 44 may be removed, and the valve may be installed behind the VR plug 42. As will be discussed in more detail below, a VR plug 42 tool (e.g., lubricator tool) may then be inserted through the valve to remove the VR plug 42. In some embodiments, the blind flange 44 may then be installed behind the valve. However, if the VR plug 42 comes loose or begins to leak, and the volume between the VR plug 42 and the blind flange 44 may become pressurized, such that removing the blind flange 44 may release bore hole and/or wellhead fluids unless the well has been "killed", thereby reducing the production of the well 16. As described in more detail below, installing a secondary VR plug behind the primary VR plug 42 (see FIG. 5) allows for tightening or replacement of the primary VR plug 42 without releasing pressure in the well 16.

Figure 2:
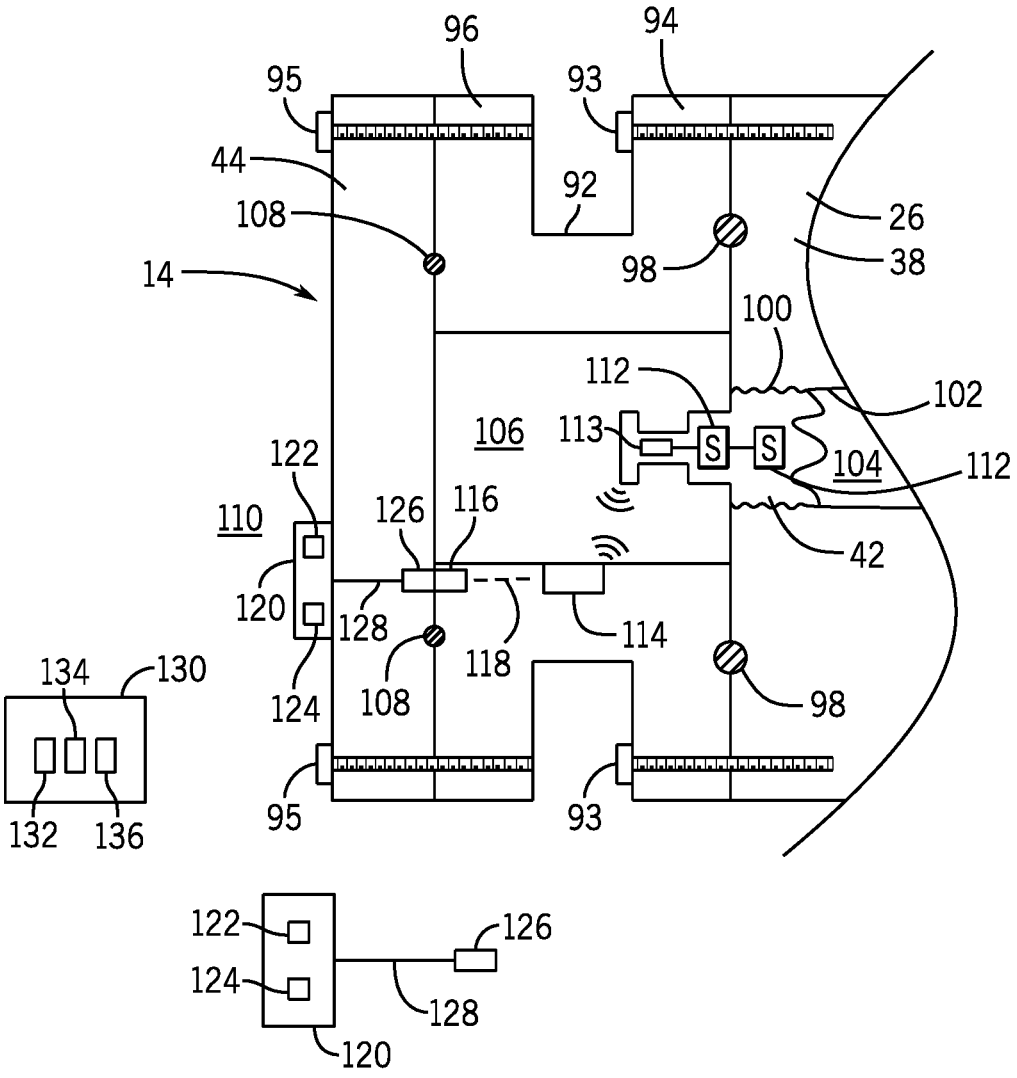
FIG. 2 is a side, section, detail view of an embodiment of a wellhead assembly of the mineral extraction system shown in FIG. 1, taken within line 2-2.

FIG. 2 is a side, section, detail view of an embodiment of the wellhead assembly 14 shown in FIG. 1, taken within line 2-2. In some embodiments, a VR plug housing 92 (e.g., annular housing) may be coupled to the flange 38 of the body 26 of the wellhead assembly 14, between the flange 38 and the blind flange 44 via a plurality of fasteners 95 (e.g., threaded fasteners or bolts). The VR housing 92 may have a first flange 94 (e.g., annular flange) coupled to the flange 38 of the wellhead assembly 14 via a plurality of fasteners 93 (e.g., threaded fasteners or bolts) and a second flange 96 (e.g., annular flange) coupled to the blind flange 44. In such an embodiment, one or more seals 98 (e.g., annular seals or o-rings) may be disposed between the flange 38 and the VR plug housing 92, forming a liquid-tight or air-tight seal. As illustrated, the VR plug 42 may have a threaded exterior surface 100, which interfaces with an interior surface 102 of the body 26, which may or may not be threaded. The VR plug 42 may form a fluid tight and/or air tight seal with the body 26. Accordingly, a first volume 104 in front of the VR plug 42 may be in fluid communication with the production bore 32 and/or annuli 34 (see FIG. 1), and thus, may be under the same or similar pressure as the well bore 18. A second volume 106 behind the VR plug 42, as a result of the seal between the VR plug 42 and the body 26, may be under a different (e.g., lower) pressure than the first volume 104. Further, as a result of the seal between the VR plug 42 and the body 26, and a seal 108 between the second flange 96 and the blind flange 44, the second volume 106 may be under a different pressure than a surrounding environment 110 (e.g., ambient air, sea water, etc.).

As previously discussed, the VR plug 42 may be a smart VR plug 42, outfitted with one or more sensors 112 for determining one or more conditions in the first volume 104, the second volume 106, or both. For example, the sensors 112 may include one or more pressure sensors, temperature sensors, fluid composition sensors, flow sensors, vibration sensors, accelerometers, or any combination thereof. Furthermore, the sensors 112 may be configured to monitor a differential in sensed conditions (e.g., pressure, temperature, fluid composition, flow, vibration, movement, etc.) between the first and second volumes 104 and 106. In certain embodiments, the sensors 112 may include non-intrusive sensors, such as ultrasonic sensors (e.g., ultrasonic flow meters). As illustrated, a wireless communications device or circuitry 113 (e.g., wireless communications transmitter or transceiver 113) of the VR plug 42 may communicate wirelessly (e.g., via Bluetooth, Near Field Communication, ZigBee, etc.) with a wireless communications device or circuitry 114 (e.g., wireless communications receiver or transceiver), which may be in communication with a communications port or plug 116 (e.g., electrical plug or data communications plug) via a connector 118 (e.g., a glass bead connector, conductor, or communications line). As appreciated, the wireless communications devices 113 and 114 may greatly simplify the installation, removal, and/or replacement of the VR plug 42 by eliminating the need to connect and disconnect wires, while also reducing or eliminating potential leak paths associated with wired connections. However, in some embodiments, the communications devices 113 and 114 may be coupled together via a wire, and thus may use wired communications alone or in combination with the wireless communications.

As discussed below, an electronic device 120 (e.g., an electronic monitor and/or controller having a processor 122 and memory 124) may be coupled to the plug 116 via a mating plug 126 and intermediate connector 128 (e.g., a glass bead connector, conductor, or communications line). The electronic device 120 may be mounted to the blind flange 44, separate from the blind flange 44, and/or elsewhere in the mineral extraction system 10. The electronic device 120 also may communicate with other electronic devices (e.g., monitors and/or controllers) throughout the mineral extraction system 10, including a remote workstation or computing device 130 having a processor 132, memory 132, and one or more input/output devices 134 (e.g., video display, audio device or speaker, etc.). The device 120 and/or 130 may be configured to monitor and analyze the sensor feedback from the sensors 112, and determine a variety of characteristics of the VR plug 42, the first volume 104, the second volume 106, or differentials there between. For example, based on feedback from the sensors 112, the device 120 and/or 130 may be configured to determine historical trends and predict future trends in the monitored conditions, including rates of change or trends in the pressure, temperature, flow rate (e.g., leakage flow), fluid composition, vibration, etc. By further example, based on feedback from the sensors 112, the device 120 and/or 130 may be configured to determine historical trends and predict future trends in a pressure differential, a temperature differential, a fluid composition differential, or a combination thereof, between the volumes 104 and 106. Using the historical and predicted trends, the device 120 and/or 130 may be configured to predict a time of failure, a lifespan, a wear rate, or other characteristics of the VR plug 42. Furthermore, using the historical and predicted trends, the device 120 and/or 130 may be configured to schedule servicing (e.g., inspection, repair, and/or replacement) of the VR plug 42.

If the VR plug 42 loosens, or the seal between the exterior surface 100 of the VR plug 42 and the interior surface 102 leaks, the second volume 106 may become pressurized such that the pressure in the second volume 106 reaches or approaches the pressure in the first volume 104. In such a scenario, removing the blind flange 44 to tighten or replace the VR plug 42 may release bore hole and/or wellhead fluids from the various fluid flow paths 32, 34 (see FIG. 1) unless the well has been "killed", which may reduce or cease the productivity of the well 16. Accordingly, an operator may decide that removing the blind flange 44 to tighten or replace the VR plug 42, or install a valve (see FIG. 1), is not worth the loss of pressure in the fluid flow paths 32, 34. As will be described in more detail below, by using a second, larger VR plug 42 behind the primary VR plug 42, an operator may tighten or replace the primary VR plug 42 or install a valve behind the VR plug 42 without losing pressure in the fluid flow paths 32, 34.

Figure 3:
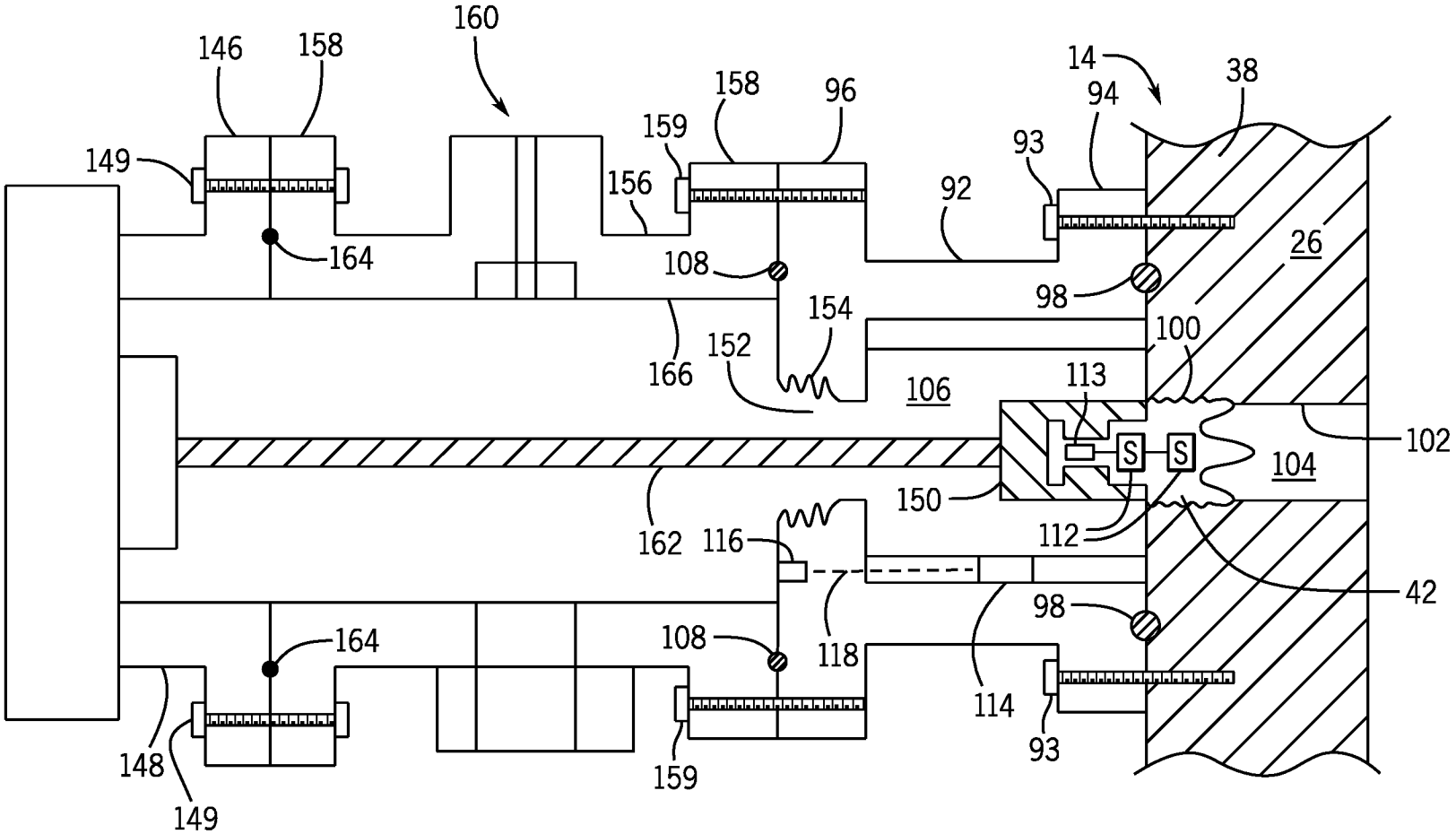
FIG. 3 is a side, section view of an embodiment of a primary VR plug being installed in the wellhead assembly using a lubricator tool.

FIG. 3 is a side, section view of an embodiment of a primary VR plug 42 being installed in the wellhead assembly 14 using a lubricator tool 150. As illustrated, the second flange 96 of the VR plug housing 92 includes a secondary VR plug recess 152, which may or may not include an interior threaded surface 154 to interface with threads on an exterior surface of a secondary VR plug. The blind flange 44 coupled to the second flange 96 in FIG. 2 has been removed and replaced with a gate valve housing 156 (e.g., annular housing). The gate valve housing 156 includes gate valve housing flanges 158 on either side, which may couple to the second flange 96 of the VR plug housing 92 via a plurality of fasteners 159 (e.g., threaded fasteners or bolts) at one end and couple to a lubricator tool housing flange 146 of a lubricator tool housing 148 via a plurality of fasteners 149 (e.g., threaded fasteners or bolts). The gate valve housing 156 includes a gate valve 160, which may open to allow fluid flow through the gate valve housing 156 and close to limit or prevent fluid flow through the gate valve housing 156.

To install the primary VR plug 42, the gate valve 160 is opened and the lubricator tool 150, carrying the primary VR plug 42, extends through the gate valve 160, through the secondary VR plug recess 152, through the VR plug housing 92, and threads the primary VR plug 42 into the flange 38 of the body 26. The lubricator tool 150 includes a shaft 162 (e.g., a telescoping shaft). The lubricator tool housing 148 also includes a seal 164 (e.g., annular seal), which forms a seal between the lubricator tool housing flange 146 of the lubricator tool housing 148 and the gate valve housing flange 158 of the gate valve housing 156 to maintain pressure in the first and second volumes 104, 106 when the primary VR plug 42 is loosened or removed.

Figure 4:
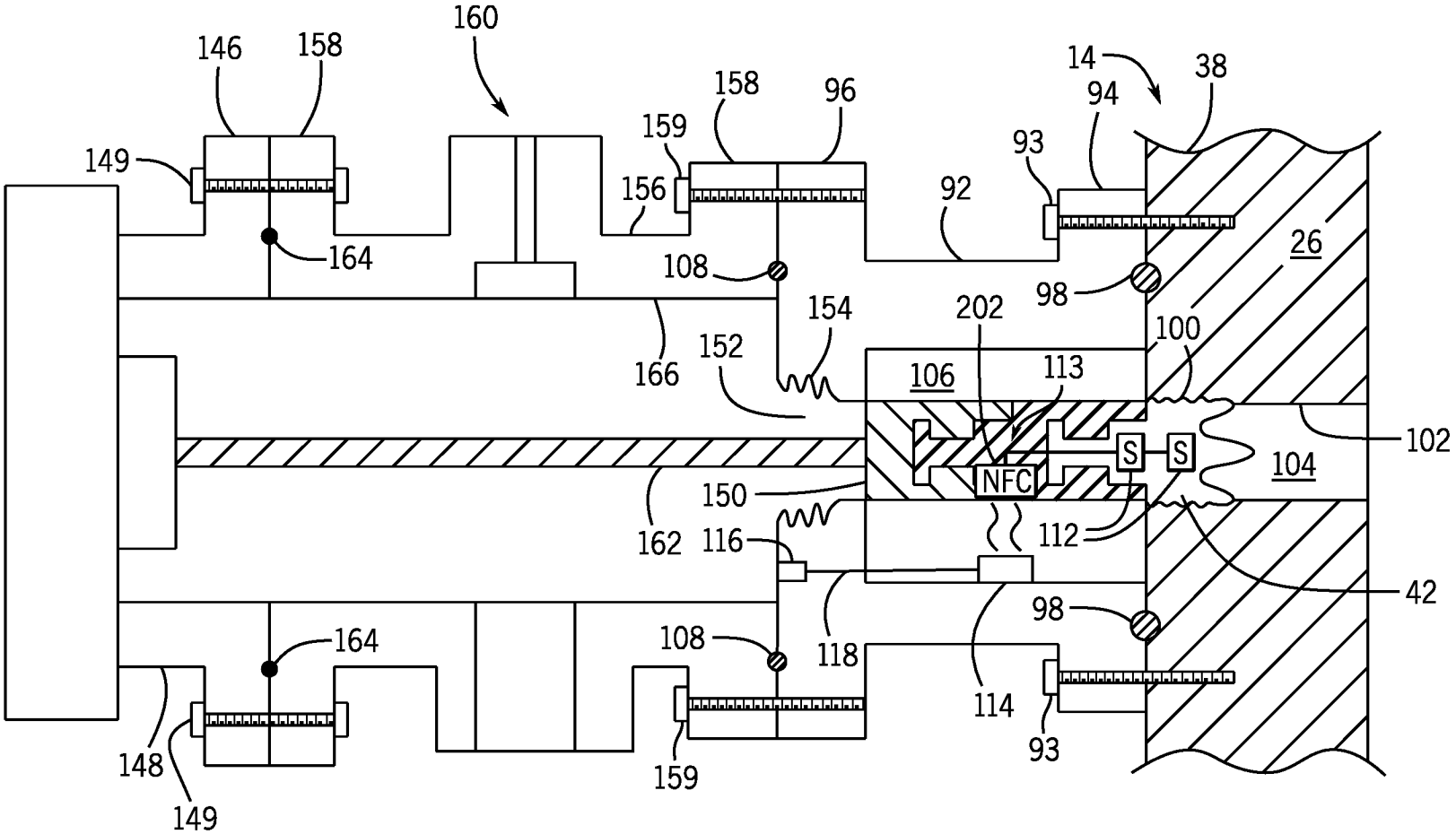
FIG. 4 is a side, section view of an electronic sleeve being coupled to the primary VR plug by the lubricator tool.
Figure 5:
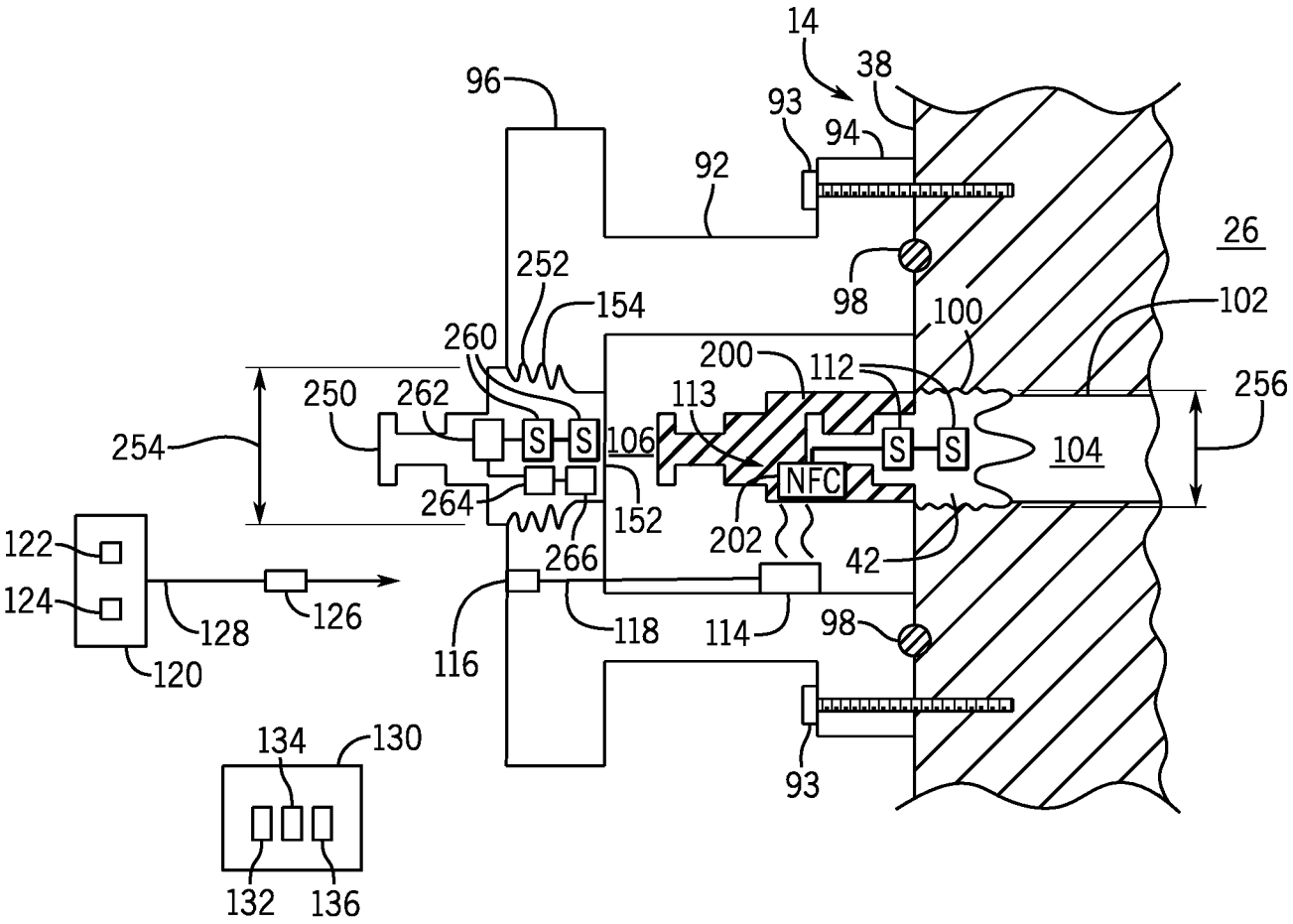
FIG. 5 is a side, section view of an embodiment of a secondary VR plug installed in a secondary VR plug recess.

FIG. 4 is a side, section view of an electronic sleeve 200 being coupled to the VR plug 42 by the lubricator tool 150. As previously discussed, the primary VR plug 42 may be outfitted with one or more sensors 112 for detecting various characteristics (e.g., temperature, pressure, fluid composition, flow rate, vibration, etc.) of the first volume 104 and/or the second volume 106. As illustrated, the electronic sleeve 200 may electrically couple to the VR plug 42, such that the electronic sleeve 200 receives signals generated by the sensors 112. The electronic sleeve 200 may include wireless communication circuitry 202 (e.g., near field communication, Bluetooth, ZigBee, etc.). The wireless communication circuitry 202 may be configured to communicate with the wireless communications device 114. For example, using the wireless communication circuitry 202, the electronic sleeve 202 may be capable of receiving signals from the sensors 112, or other data from the VR plug 42, and communicating the data to the wireless communications device 114. The wireless communications device 114 may then communicate that data via the connector 118 to the plug 116, which may receive a corresponding plug 126 (e.g., electrical plug or data communications plug) coupled to the electronic device 120 as illustrated in FIGS. 2 and 5. The electronic device 120 may be configured to monitor the feedback data from the sensors 112 in the VR plug 42, analyze the feedback data, provide information to users via a display, and/or provide control signals to various components of the mineral extraction system 10. For example, the electronic device 120 may communicate with the remote workstation or device 130. Thus, by connecting a device (e.g., electronic device 120) to the plug 116, the system (e.g., 120, 130) may monitor one or more characteristics (e.g., temperature, pressure, fluid composition, flow rate, vibration, etc.) in the first volume 104 and the second volume 106, as detected by the sensors 112. Based on these readings, the system (e.g., 120, 130) may monitor well 16 pressure, and also detect when the VR plug 42 is loose or leaking and should be tightened or replaced. It should be understood, however, that in some embodiment, the primary VR plug 42 and the electronic sleeve 200 may be combined into a single component.

With the primary VR plug tightened and forming a seal with the flange 38 of the body 26, the gate valve housing 156 may be removed and a secondary VR plug may be installed. FIG. 5 is a side, section view of an embodiment of the secondary VR plug 250 installed in the secondary VR plug recess 152. As with the primary VR plug 42, the secondary VR plug 250 has an exterior threaded surface 252, which interfaces with the threaded interior surface 154 of the VR plug housing 92, such that a seal is formed between the secondary VR plug 250 and the VR plug housing 92. As illustrated, the secondary VR plug 250 may have a diameter 254 that is sufficiently larger than a diameter 256 of the primary VR plug 42, such that the primary VR plug 42 may pass through the secondary VR plug recess 152 for installation and/or removal. For example, the diameter 254 of the second VR plug 250 and recess 152 may be at least 5, 10, 15, 20, 25, or 30 percent larger than the diameter 256 of the primary VR plug 42. In certain embodiments, the secondary VR plug 250 may be a non-smart VR plug (e.g., no sensors, electronic sleeve, or communications circuitry) or a smart VR plug (e.g., including one or more sensors 260, electronic sleeve having wired and/or wireless communications circuitry or device 262, a processor 264, memory 266, etc.). In embodiments having a smart VR plug 250, the one or more sensors 260 may be configured to measure characteristics (e.g., temperature, pressure, flow rate, fluid composition, vibration, etc.) of the second volume 106 in front of the secondary VR plug 250 and/or the volume 110 behind the secondary VR plug 250. As discussed with regard to the primary VR plug 42 in FIG. 2, sensors 260 may communicate with the electronic devices 120 and/or 130. The device 120 and/or 130 may be configured to monitor and analyze the sensor feedback from the sensors 260, and determine a variety of characteristics of the secondary VR plug 250 or the second volume 106, and/or use feedback from the sensors 260 in conjunction with feedback from the sensors 112 of the primary VR plug 42. For example, based on feedback from the sensors 112, 260 the device 120 and/or 130 may be configured to determine historical trends and predict future trends in the monitored conditions, including rates of change or trends in the pressure, temperature, flow rate (e.g., leakage flow), fluid composition, vibration, etc. By further example, based on feedback from the sensors 112, 260 the device 120 and/or 130 may be configured to determine historical trends and predict future trends in a pressure differential, a temperature differential, a fluid composition differential, or a combination thereof, between the volumes 104 and 106. Using the historical and predicted trends, the device 120 and/or 130 may be configured to predict a time of failure, a lifespan, a wear rate, or other characteristics of the VR plugs 42, 250. Furthermore, using the historical and predicted trends, the device 120 and/or 130 may be configured to schedule servicing (e.g., inspection, repair, and/or replacement) of the VR plugs 42, 250. The secondary VR plug 250 may be installed using the same or a similar lubricator tool 150 used to install the primary VR plug 42, as shown in FIG. 3, or a different tool.

Figure 6:
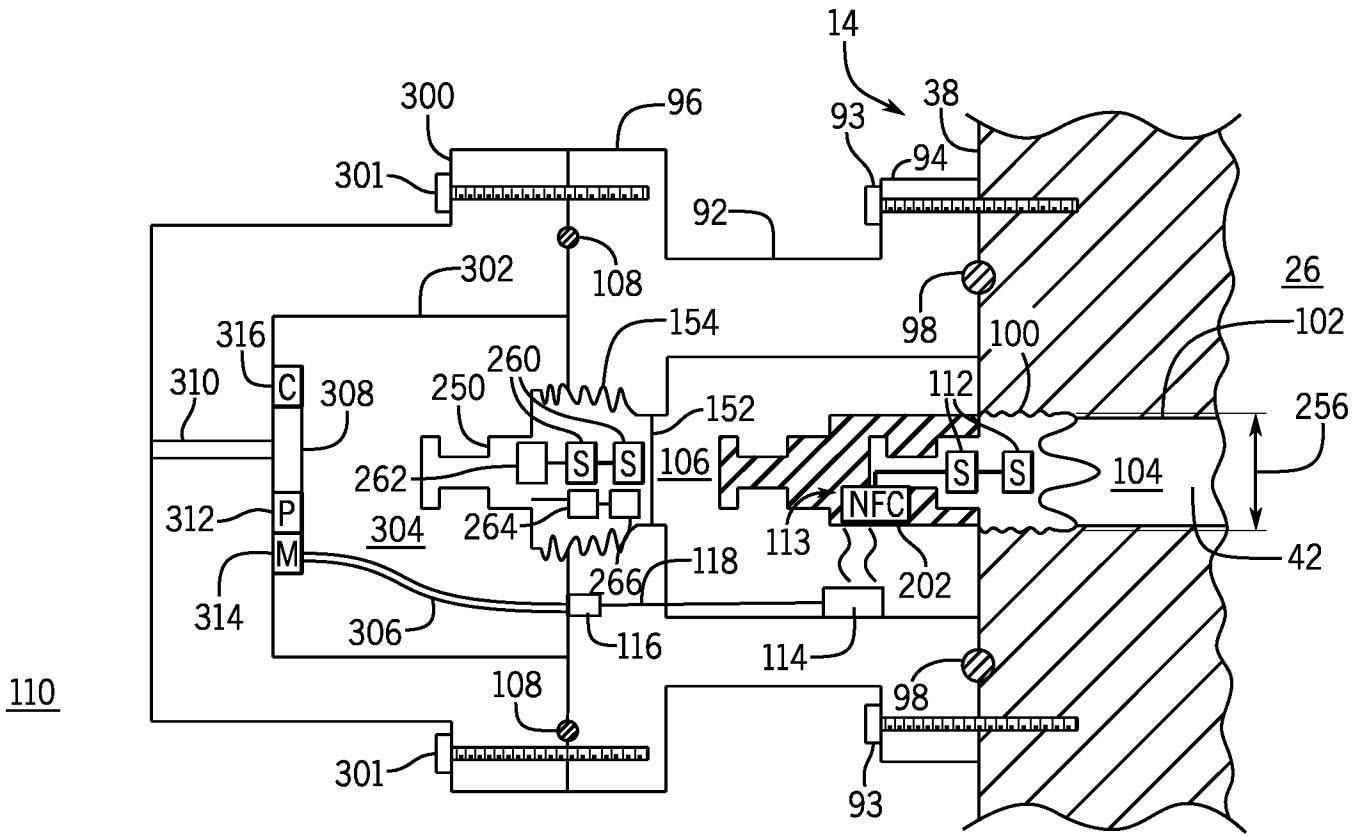
FIG. 6 is a side, section view of an embodiment of a recessed blind flange coupled to a second flange of a VR plug housing.

FIG. 6 is a side, section view of an embodiment of the wellhead assembly 14 with a recessed blind flange 300 coupled to the second flange 96 of the VR plug housing 92 via a plurality of fasteners 301 (e.g., threaded fasteners or bolts). As shown, the blind flange 300 includes a recess 302, defining a third volume 304 behind the secondary VR plug 250. The secondary VR 250 plug forms a seal with the VR plug housing 92, and the annular seal 108 in the second flange 96 of the VR plug housing 92 forms a seal with the blind flange 300 such that the third volume 304 may be pressurized relative to the second volume 106 or the environment 110 (e.g., air, sea water, etc.). A cable 306, glass bead, or inductive coupling may connect the plug 116 to a circuit board 308. In some embodiments, the circuit board 308 may include a processor 312 and/or a memory 314. The processor 312 may run programs stored on the memory 314. The processor 312 may include one or more general-purpose processors, one or more application specific integrated circuits, one or more field programmable gate arrays, or the like. The memory 314 may be any tangible, non-transitory, computer readable medium that is capable of storing instructions executable by the processor 312 and/or data that may be processed by the processor 312. The memory 314 may include volatile memory, such as random access memory, or non-volatile memory, such as hard disk drives, read-only memory, optical disks, flash memory, and the like. In some embodiments, the circuit board 308 may include communication circuitry 316 for wired or wireless communication (e.g., near field communication) with the VR plugs 42 and/or 250. The circuit board 308 may be used, for example, to receive signals from the sensors 112 and/or 260 (e.g., via wired or wireless communication) and to convert the sensor 112 signals to a desired output. The circuit board 308 may be coupled to a glass bead 310 or inductive coupling extending through the blind flange 300. Accordingly, a user may connect a device (e.g., 120, 130) to the glass bead 310 or inductive coupling to receive the signals (e.g., indicative of temperature and/or pressure in the first volume 104 and/or the second volume 106) output by the sensors 112, 260 in the VR plugs 42, 250. Based on the outputs of the sensors 112, 260 the system may be able to determine when the VR plugs 42, 250 are loose or leaking, enabling notification of a need for corrective action to tighten or replace the VR plugs 42, 250 without losing pressure in the well 16.

Figure 7:
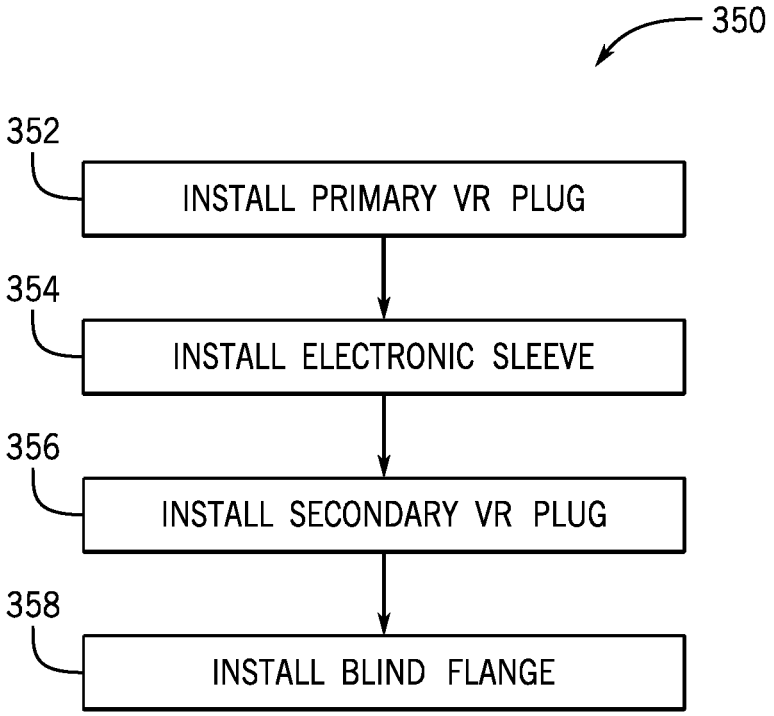
FIG. 7 is a flow chart of a process for installing the primary VR plug, the secondary VR plug, and the blind flange.

FIG. 7 is a flow chart of a process 400 for installing the primary VR plug 42, the secondary VR plug 250, and the blind flange 300, as shown in FIG. 6. In block 352 the primary VR plug 42 is installed. The primary VR plug 42 may be installed in a flange 38 of the body 26 of the wellhead assembly 14. Specifically, the threaded exterior surface 100 of the primary VR plug 42 may interface with a threaded interior surface 102 of a flange 38 of the body 26, forming a seal between the primary VR plug 42 and the flange 38. In some embodiments, the primary VR plug 42 may be installed using the lubricator tool 150, extending through a valve 160 to maintain pressure in the well 16. In other embodiments, the primary VR plug 42 may be directly installed in a flange 38 of the body 26 using hand tools.

In block 354, the electronic sleeve 200 may be installed on the primary VR plug 42. The electronic sleeve 200 may be installed through a valve 160, or directly onto the primary VR plug 42. The electronic sleeve 200 may be installed using the lubricator tool 150, a different tool, or by hand. In some embodiments, an electronic sleeve 200 may not be used. For example, the primary VR plug 42 may not be a smart VR plug equipped with sensors. In other embodiments, the communication circuitry 202 of the electronic sleeve 200 may be incorporated into the primary VR plug 42, such that an electronic sleeve 200 is not separately installed.

In block 356, the secondary VR plug 250 is installed. The secondary VR plug 250 may be installed in a flange 96 of the VR plug housing 92, which may be coupled to the flange 38 of the body 26. Specifically, the threaded exterior surface 154 of the secondary VR plug 250 may interface with a threaded interior surface of the secondary VR plug recess 152 of the second flange 96 of the VR plug housing 92, forming a seal between the secondary VR plug 250 and the VR plug housing 92. In some embodiments, the secondary VR plug 250 may be installed using the lubricator tool 150, extending through the valve 160. In other embodiments, the secondary VR plug 250 may be directly installed in the VR plug recess 152 of the second flange 96 of the VR plug housing 92 using hand tools.

In block 358, the blind flange 300 is installed over the secondary VR plug 250, forming a seal with the second flange 96 of the VR plug housing 92. The blind flange 300 may be coupled to the VR plug housing 92 using a plurality of fasteners 301 (e.g., bolts) disposed circumferentially about the blind flange 300 and the second flange 96. In other embodiments, the blind flange 300 and the second flange 96 of the VR plug housing 92 may be coupled to one another using a mating geometry (e.g., threads, j-slots, locking tabs, etc.) and/or a fixed coupling (e.g., a welded joint). Once the primary VR plug 42, the secondary VR plug 250, and the blind flange 300 are installed, as shown in FIG. 6, the user may connect a device (e.g., 120, 130) to the glass bead 300 or induction coupling to monitor the conditions within the various volumes 104, 106, 304, in order to determine if the primary VR plug 42 and/or the secondary VR plug 250 is leaking or loose. If a leaking or loose primary VR plug 42 is detected, the primary VR plug may be tightened or replaced.

Figure 8:
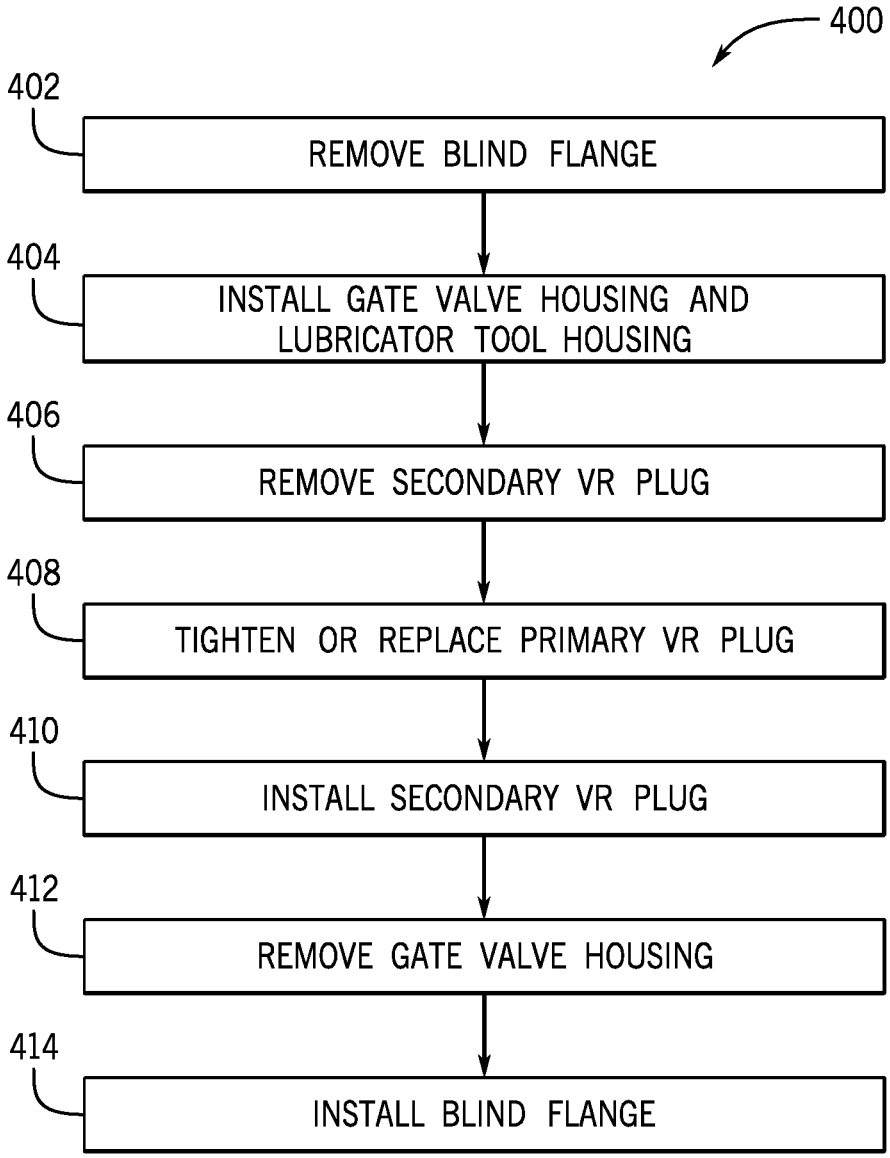
FIG. 8 is a flow chart of a process for tightening or replacing the primary VR plug.

FIG. 8 is a flow chart of a process 400 for tightening or replacing the primary VR plug 42. In block 402 the blind flange 300 is removed. As previously discussed, this may be done by loosening or removing fasteners, or otherwise decoupling mating geometry between the blind flange 300 and the second flange 96 of the VR plug housing 92.

In block 404, the valve housing 156 having the valve 160 (e.g., a gate valve) and the valve housing flange 158 is coupled to the second flange 96 of the VR plug housing 92 and the lubricator tool housing 148 is coupled to the valve housing 156. The flanges 146, 158, 96 include one or more seals 108, 164, forming an air tight or fluid tight seal between the VR plug housing 92 and the valve housing 156, and between the valve housing 156 and the lubricator tool housing 148. The flanges 146, 158, 96 may mate to one another via fasteners 149, 159, mating geometry, or some other way. The valve 160 may open and close to allow the tool 150 to install, tighten, loosen, or remove the primary VR plug 42 or the secondary VR plug 250. The seal 164 (e.g., annular seal) between the lubricator tool housing flange 146 of the lubricator tool housing 148 and the valve housing flange 158 of the valve housing 156 forms a seal between the lubricator tool housing flange 146 of the lubricator tool housing 148 and the valve housing flange 158 of the valve housing 156, such that the a seal is maintained while the tool 150 is being used on the secondary VR plug 250 or the primary VR plug 42.

In block 406, the secondary VR plug 250 is removed. As previously discussed, the gate valve 160 may open to allow the tool 150 to access the secondary VR plug 250. The tool 150 may then remove the secondary VR plug 250.

In block 408, the tool 150 tightens or replaces the primary VR plug 42. In some embodiments, the tool 150 may merely tighten the primary VR plug 42 if it has been determined that the primary VR plug 42 is loose. However, if the primary VR plug 42 should be replaced (e.g., the primary VR plug 42 is cracked or broken), the tool 150 may remove the primary VR plug 42 and install a new primary VR plug 42. It should be understood that because the seal 164 (e.g., annular seal) between the lubricator tool housing flange 146 of the lubricator tool housing 148 and the valve housing flange 158 of the valve housing 156, pressure in the well 16 is maintained or substantially maintained when the primary VR plug 42 is removed. Accordingly, the primary VR plug 42 may be tightened or replaced without affecting well 16 productivity.

In block 410, the secondary VR plug 250 is installed. The secondary VR plug 250 may or may not be installed and removed using the same tool 150 as the primary VR plug 42.

In block 412 the gate valve housing 156 is removed. Because the primary VR plug 42 and the secondary VR plug 250 are installed, the gate valve housing 156 may be removed while maintaining pressure in the well 16.

In block 414 the blind flange 300 is installed over the secondary VR plug 250, forming a seal with the second flange 96 of the VR plug housing 92. The blind flange 300 may be coupled to the VR plug housing 92 using a plurality of fasteners 301 (e.g., bolts) disposed circumferentially about the blind flange 300 and the second flange 96. In other embodiments, the blind flange 300 and the second flange 96 of the VR plug housing 92 may be coupled to one another using a mating geometry (e.g., threads, j-slots, locking tabs, etc.). Once the primary VR plug 42, the secondary VR plug 250, and the blind flange 300 are installed, as shown in FIG. 6, the user may connect a device (e.g., 120, 130) to the glass bead 300 or induction coupling to monitor the conditions within the various volumes 104, 106, 304, in order to determine if the primary VR plug 42 and/or the secondary VR plug 250 is leaking or loose.

The disclosed techniques allow for the detection of a loose or leaking VR plug, and the tightening or replacement of the VR plug without releasing bore hole and/or wellhead fluids unless the well has been "killed". Present embodiments include a secondary VR plug disposed behind a primary VR plug. The primary VR plug may include one or more sensors for determining when the primary VR plug is loose or leaking. A valve housing and a blind flange may be interchangeably coupled to the VR plug housing. During normal operation, the blind flange is used. When a loose or leaking VR plug is discovered, the blind flange may be replaced with a valve housing with a valve (e.g., gate valve). A tool may then be inserted through the valve to remove or tighten the primary VR plug and/or the secondary VR plug.

The tool housing may include a seal, thus maintaining pressure in the well when the primary and secondary VR plugs are being worked on removed, loosened, tightened, or installed by the tool. As such, the primary and secondary VR plugs may be tightened or replaced without affecting well pressure.

While the disclosure may be susceptible to various modifications and alternative forms, specific embodiments have been shown by way of example in the drawings and have been described in detail herein. However, it should be understood that the disclosure is not intended to be limited to the particular forms disclosed. Rather, the disclosure is to cover all modifications, equivalents, and alternatives falling within the spirit and scope of the disclosure as defined by the following appended claims.

The invention claimed is:

1. A system, comprising:

a first valve removal (VR) plug, comprising:

a sensor configured to sense a first characteristic of a first volume adjacent to the first VR plug; and a wireless transmitter configured to wirelessly transmit a signal indicative of the first characteristic, wherein the first VR plug is configured to form a first seal with a body of a mineral extraction component;

a VR plug housing, comprising:

a first flange configured to be disposed about the first VR plug and to couple to the body of the mineral extraction component;

a second flange comprising an interior threaded surface that defines a second VR plug recess;

a receiver configured to receive the signal indicative of the first characteristic from the wireless transmitter;

a communications port disposed within the second flange; and a connector communicatively coupled to the receiver and the communications port, wherein the connector extends from the receiver, through the second flange, to the communications port;

wherein the receiver is configured to communicate the signal indicative of the first characteristic to the communications port via the connector; and a second VR plug comprising a threaded exterior surface configured to engage with the threaded interior surface of the second VR plug recess to form a second seal between the second VR plug and the VR plug housing.

2. The system of claim 1, comprising an electronic sleeve disposed about the first VR plug, the electronic sleeve comprising the wireless transmitter.

3. The system of claim 1, comprising a blind flange configured to be coupled to, and form a third seal with, the second flange of the VR plug housing and disposed about the second VR plug.

4. The system of claim 3, wherein the blind flange comprises a circuit board configured to receive the signal indicative of the first characteristic, convert the signal to a desired output, and transmit the converted signal.

5. The system of claim 4, wherein the blind flange comprises a glass bead or an inductive coupling by which the converted signal is transmitted from the communications port to the circuit board.

6. The system of claim 1, comprising a gate valve housing, comprising:

a gate valve housing flange configured to couple to, and form a fourth seal with, the second flange of the VR plug housing; and a gate valve configured to open and close.

7. The system of claim 6, comprising a lubricator tool configured to extend through the gate valve housing and the VR plug housing to install or remove the first VR plug and the second VR plug.

8. The system of claim 1, wherein the first VR plug comprises a second sensor configured to sense a second characteristic of a second volume adjacent to the first VR plug, the first and second volumes are on opposite sides of the first VR plug, and the signal wirelessly transmitted by the wireless transmitter is indicative of the first characteristic and the second characteristic.

9. A system, comprising:

a first valve removal (VR) plug, comprising:

a first sensor configured to sense a first characteristic of a first volume adjacent to the first VR plug; and a wireless transmitter configured to wirelessly transmit a signal indicative of the first characteristic, wherein the first VR plug is removable to enable installation of a valve along a fluid passage; and a VR plug housing, comprising:

a first flange configured to be disposed about the first VR plug and to couple to a body of a mineral extraction component;

a second flange, comprising a communications port;

a receiver configured to receive the signal indicative of the first characteristic from the wireless transmitter; and a connector communicatively coupled to the receiver and the communications port, wherein the connector extends from the receiver, through the second flange, to the communications port;

wherein the receiver is configured to communicate the signal indicative of the first characteristic to the communications port via the connector.

10. The system of claim 9, wherein the first VR plug comprises a second sensor configured to sense a second characteristic of a second volume adjacent to the first VR plug, and the first and second volumes are on opposite sides of the first VR plug.

11. The system of claim 10, wherein the first VR plug housing defines the second volume in fluid communication with the first VR plug.

12. The system of claim 10, wherein the system is configured to predict trends in monitored conditions based on feedback from the first sensor, the second sensor, or both.

13. The system of claim 10, wherein the system is configured to determine differentials in monitored conditions on the opposite sides of the first VR plug.

14. The system of claim 9, wherein the system is configured to monitor the first sensor during installation, removal, or servicing of the first VR plug.

15. The system of claim 9, comprising:

a blind flange configured to be coupled to the second flange of the VR plug housing, wherein the blind flange comprises a circuit board configured to receive the signal indicative of the first characteristic; and a glass bead or an inductive coupling communicatively coupling the communications port to the circuit board.

16. A system, comprising:

a first valve removal (VR) plug configured to seal a fluid passage, wherein the first VR plug comprises:

a first sensor configured to sense a first characteristic of a first volume adjacent to the first VR plug;

a second sensor configured to sense a second characteristic of a second volume adjacent to the first VR plug, wherein the first and second volumes are on opposite sides of the first VR plug; and a wireless transmitter configured to wirelessly transmit a signal indicative of the first characteristic and the second characteristic to a receiver of a first housing disposed about the first VR plug;

wherein the first housing comprises:

a first flange configured to be disposed about the first VR plug and to couple to a body of a mineral extraction component;

a second flange, comprising a communications port;

the receiver, wherein the receiver is configured to receive the signal indicative of the first characteristic and the second characteristic from the wireless transmitter; and a connector communicatively coupled to the receiver and the communications port, wherein the connector extends from the receiver, through the second flange, to the communications port;

wherein the receiver is configured to communicate the signal indicative of the first characteristic and the second characteristic to the communications port via the connector.

17. The system of claim 16, comprising a second VR plug configured to seal the fluid passage, and a second housing having a third volume in fluid communication with the second VR plug.

18. A system, comprising:

a first housing, comprising:

a first flange configured to be disposed about a first VR plug and to couple to a body of a mineral extraction component;

a second flange, comprising a communications port;

a receiver configured to receive a signal indicative of a first characteristic of a first volume adjacent to the first VR plug from a wireless transmitter of the first VR plug; and a connector communicatively coupled to the receiver and the communications port, wherein the connector extends from the receiver, through the second flange, to the communications port;

wherein the receiver is configured to communicate the signal indicative of the first characteristic to the communications port via the connector.

19. The system of claim 18, comprising a second housing having a second volume configured to receive a second VR plug, wherein the second housing is configured to couple to the first housing.

20. The system of claim 18, wherein the receiver is configured to receive the signal indicative of the first characteristic and a second characteristic.

21. The system of claim 18, comprising:

a blind flange configured to be coupled to the second flange of the first housing wherein the blind flange comprises a circuit board configured to receive the signal indicative of the first characteristic; and a glass bead or an inductive coupling communicatively coupling the communications port to the circuit board.

* * * * *